United States Patent [19]

Bossard et al.

[11] Patent Number: 4,757,422

[45] Date of Patent: Jul. 12, 1988

[54] DYNAMICALLY BALANCED IONIZATION BLOWER

[75] Inventors: Peter R. Bossard, Langhorne; Robert H. Dunphy, Jr.; Michael R. Betker, both of Holland, all of Pa.

[73] Assignee: Voyager Technologies, Inc., Langhorne, Pa.

[21] Appl. No.: 906,907

[22] Filed: Sep. 15, 1986

[51] Int. Cl.[4] ..... H05F 3/04

[52] U.S. Cl. ..... 361/231; 361/235

[58] Field of Search ..... 361/229, 230, 231, 235; 55/104–106, 139, 151; 323/280, 903

[56] References Cited

U.S. PATENT DOCUMENTS

| | | | |
|---|---|---|---|
| 2,264,495 | 12/1941 | Wilner | 361/235 |
| 3,910,778 | 10/1975 | Shahgholi et al. | 55/102 |
| 3,936,698 | 2/1976 | Meyer | 361/235 |
| 3,973,927 | 8/1976 | Furchner et al. | 55/106 |
| 4,107,756 | 8/1978 | Best et al. | 361/235 X |
| 4,162,144 | 7/1979 | Cheney | 361/229 |
| 4,227,894 | 10/1980 | Proynoff | 361/231 |
| 4,244,712 | 1/1981 | Tongret | 55/124 |
| 4,250,431 | 2/1981 | Sugarman | 361/231 |
| 4,318,152 | 3/1982 | Weber | 55/104 X |
| 4,503,477 | 3/1985 | Henriksen et al. | 361/235 X |
| 4,643,745 | 2/1987 | Sakakibara et al. | 55/151 X |

FOREIGN PATENT DOCUMENTS

| | | | |
|---|---|---|---|
| 2622749 | 12/1977 | Fed. Rep. of Germany | 361/231 |
| 2117676 | 10/1983 | United Kingdom . | |

*Primary Examiner*—L. T. Hix
*Assistant Examiner*—D. Rutledge
*Attorney, Agent, or Firm*—Nixon & Vanderhye

[57] ABSTRACT

A dynamically balanced ion generator is provided which incorporates a detection screen and feedback loop to ensure that the number of positive and negative ions emitted from the generator are substantially equal. The detection screen is located between the ion generating electrodes and the exit port of the device, and is contructed of conductive material which captures a predetermined percentage of ions emitted by the electrodes. The detected imbalance is corrected through a feedback loop comprising an operational amplifier circuit, a low pass filter, a balance control comparator, variable duty cycle oscillator. By varying the duty cycle of the variable duty cycle oscillator, the voltage applied to the primary of a high voltage transformer is controlled such that the relative concentrations of positive and negative ions generated may be altered to compensate for any detected imbalance.

27 Claims, 2 Drawing Sheets

DYNAMICALLY BALANCED IONIZATION BLOWER

BACKGROUND OF THE PRESENT INVENTION

In recent years, a great deal of attention has been focused on the establishment of optimum climatic conditions in the workplace and home. This attention has produced a variety of air conditioning, filtration and purification devices and processes intended to create germ and dirt free environments in closed, interior spaces.

In workplaces such as an electronic assembly plant, it is well recognized that an out of balance concentration of positive or negative ions should be avoided. In such an assembly plant, workers deal with printed circuit boards having a wide variety of electronic components mounted thereon. These components are susceptible to damage due to static discharge. Because each of the components on the circuit board may not be grounded, it is highly desirable to keep the work area relatively free of static charges. In test facilities where, for example, integrated circuit wafers are tested, it is likewise essential to keep the workplace free of static charges.

It has also been determined that an appropriate concentration ratio between positive and negative ions contributes to the establishment of a healthy, and pleasing environment. Reports on this subject generally conclude that negative ions are beneficial to good health and that a predominance of positive ions, which is typically found to be the case, is detrimental. For the above reasons, ion generators have become increasingly popular.

Several approaches have been taken with respect to ion generation and the achievement of optimum interior climatic conditions. Because negative ions are generally regarded as beneficial, some known ion generators do no more than generate negative ions without any particular regard for the overall concentration ratio between positive and negative ions. Examples of such negative ion generators may be found in U.S. Pat. Nos. 4,244,712; 4,227,894 and 3,910,778.

Other negative ion generating devices are known which attempt to balance the ion concentration ratio by regulating the emission of negative ions. See, for example, U.S. Pat. No. 3,973,927.

Still other ion generating apparatus have been developed which generate both positive and negative ions. In U.S. Pat. No. 2,264,495 for example, a sensor monitors air flow into an ion generator and, in response, the device generates positive or negative ions in order to maintain constant a desired ion concentration. In U.S. Pat. No. 3,936,698, positive and negative ion generators are activated in alternating cycles. In UK Patent Application GB No. 2,117,676, separate negative ion generator and positive ion electrifier devices are used to clean room air.

When ion blowers operate in an out of balance condition and generate a net positive or negative ions, articles adjacent such blowers tend to become charged and may suffer electrostatic damage. In this regard, as noted above, electronic components in an electronic assembly plant are particularly susceptible to damage due to static discharge. In addition, electrically charged particles adjacent an ion generator attach themselves to particulate matter in the air and are attracted to the nearest ground. Thus, adjacent walls and/or equipment often have a dirty film deposited thereon.

Attempts have been made to solve this problem by, for example, adding an electrically conductive particle collector to the outlet of the generator (U.S. Pat. No. 4,250,431), or by mixing negatively charged particles exhausted from a first electrostatic precipitator with positively charged particles exhausted from a second electrostatic precipitator.

SUMMARY OF THE INVENTION

The present invention relates to an ion blower which generates positive and negative ions and, through the incorporation of a detection screen and feedback loop, continuously senses, and compensates for, any ion imbalance to insure that the number of positive and negative ions flowing out of the blower are substantially equal.

In the present invention, positive and negative ions are generated in a conventional manner, using a voltage source which, through a high voltage transformer and a coupling capacitor, impresses alternating positive and negative high voltages, i.e., more than 2500 volts, on an ion grid containing ion generating pin electrodes. Regardless of which polarity ion is being generated, a fan is used to blow air across the pin electrodes to distribute the ions.

In a preferred embodiment of this invention, a detection screen is located within the housing of the ion blower in the ion exit port for the purpose of capturing some of the ions produced by the electrodes. The detection screen is constructed of a suitable conducting material and is held at a virtual ground with a low impedance operational amplifier circuit. The size of the screen and the spacing between the individual wires which comprise the screen determines what percentage of the generated ions will be absorbed by the screen.

In addition, a similar screen held at ground potential is placed between the ion generating electrodes and the detection screen to terminate electric field lines emanating from the electrodes. This enables the detection screen to respond to actual ion flow with minimal interference from the electric field.

Current generated by and proportionate to, any sensed ion imbalance flows through the operational amplifier circuit and is filtered, with the output going to a variable duty cycle oscillator running at a fixed frequency. The duty cycle of the oscillator is determined by the detected ion imbalance. The oscillator output controls a transformer drive circuit which alternately grounds either side of a center tapped primary, high voltage, step up transformer, the center tap being tied to a fixed DC voltage.

By adjusting the duty cycle of the oscillator, the relative concentration of positive and negative ions can be controlled. An offset adjust is included in order to permit the ion balance to be changed to include more of one polarity ion than the other. In addition, a shutdown circuit is included to disable the unit if an imbalance condition is detected which cannot be offset in a reasonable period of time or if less than a minimum level of ion generation is detected.

Thus, it is seen that the present invention utilizes a feedback loop to continuously monitor and compensate for a detected ion imbalance to insure that the output of the blower is substantially equally balanced between negative and positive ions. As a result, objects adjacent the blower are not charged and the potential for electrostatic damage is substantially eliminated; adjacent objects are not soiled by charged particulate matter; and, over a period of time, the room air tends to have a balanced ion concentration which is desirable for a healthy environment.

Accordingly, it is a principal object of the invention to provide an improved ion generating apparatus which insures a balanced ion concentration output to eliminate the possibility of electrostatic charge build-up on objects adjacent the generator.

DETAILED DESCRIPTION OF THE DRAWINGS

Figure 1:
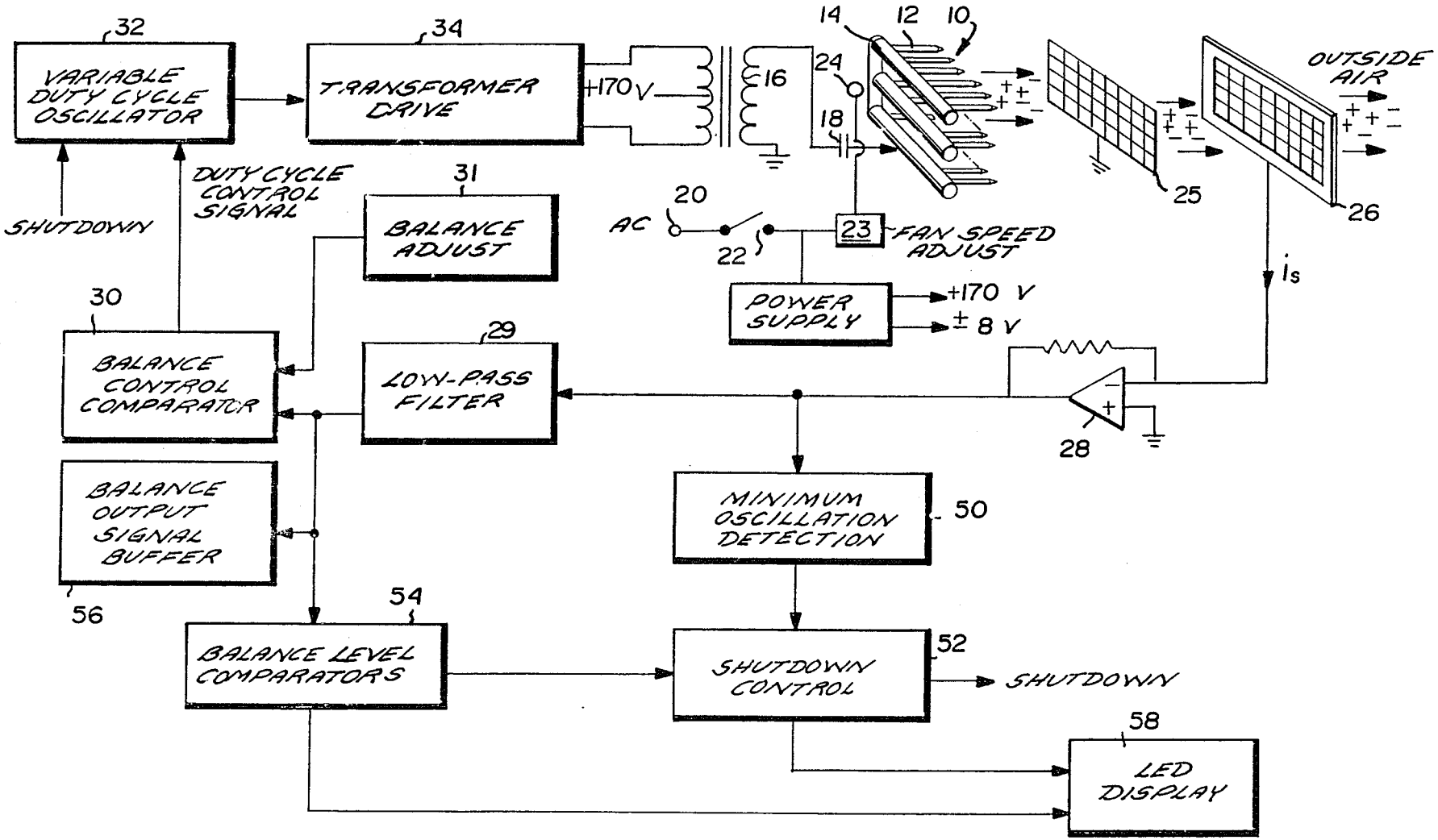
FIG. 1 is a schematic view of an exemplary embodiment of the ion blower of this invention, including a block diagram of feedback control circuitry for balancing ion concentration.

FIG. 1 shows a schematic representation of an ion generating apparatus according to an exemplary embodiment of the invention which includes an ion grid 10 having an array of electrodes 12 which generate both positive and negative ions. These electrodes 12 are shown to be a conventional stainless or tungsten alloy steel, elongated pin-type, mounted to vertically aligned base elements 14. It is to be noted, however, that any of several well known positive and negative ion generators could be used to achieve the desired results in the same manner as does this invention.

The ion generators are operatively connected to a power supply which, by way of example only, includes a center tapped primary, high voltage, step up transformer 16 and a coupling capacitor 18. The operation of these components is well known to those skilled in the art. As the artisan will also realize, although capacitive coupling is preferred, transformer 16 may alternatively be coupled to the ion grid 12 via resistive coupling.

The transformer and capacitor are chosen so that a positive or negative voltage of at least 2500 volts is applied to the electrodes 12. Electrical energy is supplied to the device through a conventional electrical plug 20 via on-off switch 22. Power supply 21 supplies a fixed DC voltage of, for example, 170 volts to the center tap of the primary transformer 16 and the bias voltages for the other circuit components of the present invention. A fan 24 is located adjacent and upstream of the ion generators and serves to blow air across the electrodes to blow the ions generated by the electrodes out into the interior room atmosphere. Fan 24 may be controlled by fan speed adjust 23 to operate at high, medium, and low speeds.

Adjacent an air outlet port provided in a housing surrounding the blower, to be described below with reference to FIG. 2, there is mounted a detection screen 26 through which the generated ions must pass prior to exiting the blower. The screen, formed of a suitable conducting material, is designed to capture, for example, 10% of the generated ions. The exact percentage of ions captured is determined by the size of the openings in the screen material. In a preferred embodiment, the screen may be composed of 20 gauge stainless steel wire with ¼ inch spacing between vertical and horizontal rows of wire.

A ground screen 25 is located between electrodes 12 and detection screen 26. The purpose of ground screen 25 is to terminate electric field lines emanating from electrodes 12 which may otherwise influence the detection screen 26 to inaccurately reflect the net ion current flowing through it. Ground screen 25 allows a large percentage of the ions to pass through it.

Any ion imbalance which is detected in screen 26 produces a net current flow $i_s$ at the inverting input of an operational amplifier circuit 28, which holds the screen at a virtual ground. The operational amplifier circuit is acting as a transresistive amplifier, i.e., as a current to voltage converter, and supplies an AC output voltage proportional to the oscillating signal current $i_s$ from detection grid 26. Thus, for example, if screen 26 detects an overabundance of net negative ions generated by electrodes 12, a negative current proportionate to the imbalance is produced. If $i_s$ is negative, the output voltage of the operational amplifier is positive. If, on the other hand, $i_s$ is positive then the amplifier output voltage will be negative.

In a preferred embodiment of the invention, the operational amplifier 28 should be capable of minimum current resolution, i, of approximately $500\times10^{-12}$ amperes, as determined by the following:

$$i=S\times V\times X\times \Delta\times 1.6\times 10^{-19}$$

wherein

S=ion density generated by the blower which, for purposes of this example, is $10^7$ ions/cc, the net charge on each ion being equal to $1.6\times10^{-19}$ coulombs;

V=volume of ionized air passing through the screen which, for purposes of this example, is $^{300}ft^3$/min.;

X=percentage of ions captured by the screen, for example, 10%;

Δ=percentage within which ion density is balanced, for example, 0.05%.

The output of the operational amplifier circuit 28 will be an alternating waveform whose frequency, e.g., 60 Hz or 600 Hz, is the same as the frequency of the variable duty cycle oscillator 32 which will be described below. This output signal is transmitted to the input of low pass filter 29 which responds to an average imbalance over many cycles of positive and negative ion generation to produce a very low frequency signal, e.g., less than 1 Hz, which represents the net ion imbalance, whether positive or negative. The low pass filter 29 filters out the high frequency components of the output of op amp 28 which are above 1 Hz and passes the D.C. component, i.e., 0 Hz. This signal represents the net positive or negative ion imbalance over many cycles.

Figure 3:
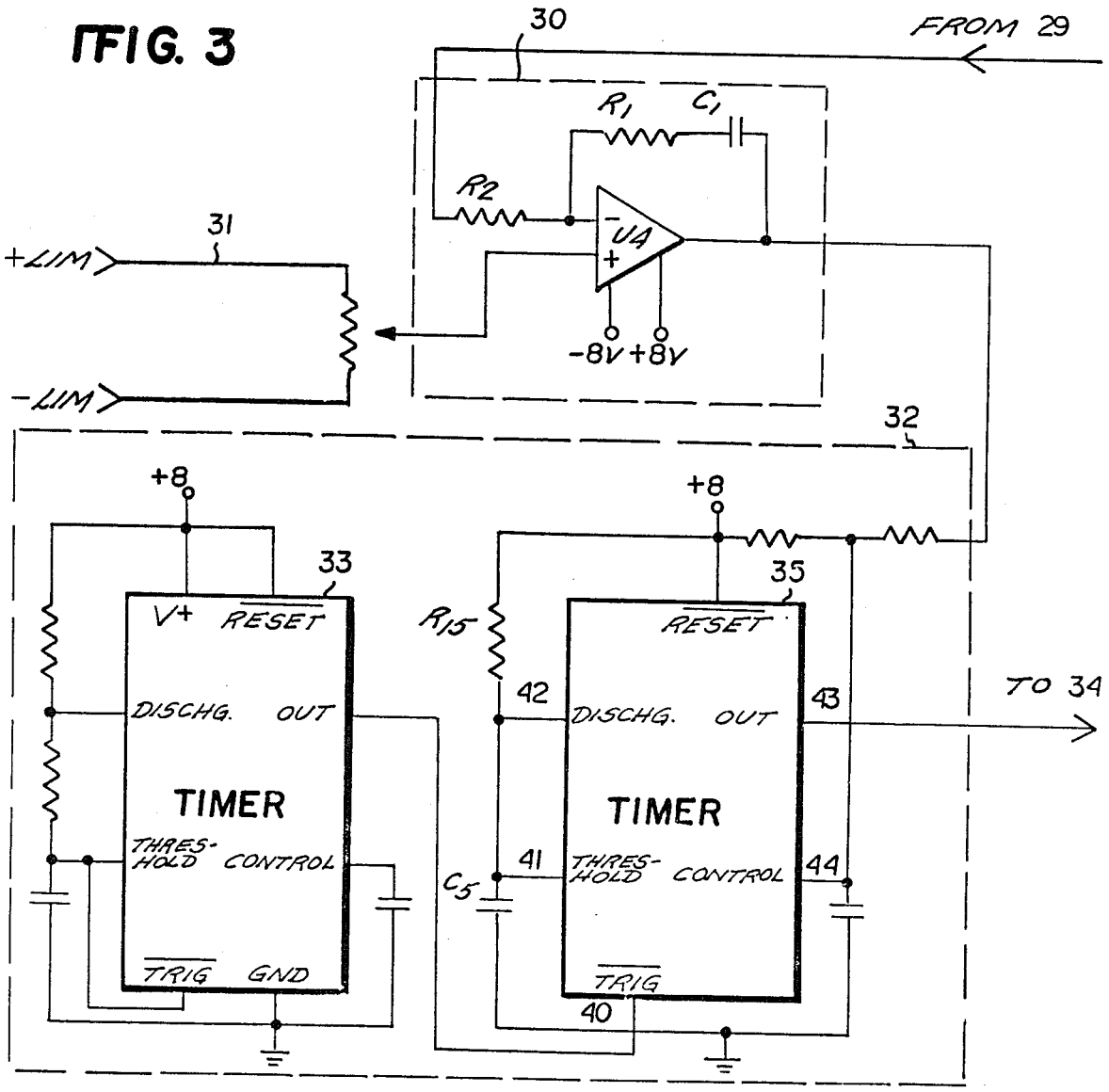
FIG. 3 is a detailed schematic of the balance control comparator, the balance adjust and the variable duty cycle oscillator shown in FIG. 1.

The low pass filter 29 output is connected to the inverting input of balance control comparator 30. The other input to comparator 30 is connected to balance adjust 31 which, as shown in FIG. 3 may, for example, may be comprised of a potentiometer. The potentiometer's resistance can be adjusted to provide a balance control output signal which will cause the ion balance of the blower to be set to a slightly positive or slightly negative setting determined by a particular user's needs. Thus, the ion blower of the present invention may be controlled to provide a slightly negative ion balance as may be desirable for health reasons. Alternatively, the ion blower may be controlled to provide a positive or negative ion balance in order to compensate for the ions generated by another high voltage electrical device or other ion source in the vicinity.

The balance control comparator 30 compares a predetermined desired balance level, i.e., the balance adjust signal, with the ion balance output signal from low pass filter 29 and generates a duty cycle control signal. This control signal adjusts the duty cycle of variable duty cycle oscillator 32, which via transformer drive 34, causes one side of high voltage transformer 16 to be grounded for a longer period of time than the other to thereby induce a positive or negative high voltage at the transformer output.

Balance control comparator 30 and the variable duty cycle oscillator 32 are shown in more detail in FIG. 3. Balance control comparator 30 includes comparator U4, which may comprise IC TLC27L2ACP. Comparator U4 has an RC feedback loop connected to its inverting input. In the exemplary embodiment, R1 and R2 have been chosen to provide a closed loop gain of 10. This feedback circuit will balance the comparator output signal so that there is no net offset between the predetermined desired balance level and the output level from low pass filter 29. Capacitor C1 will store the voltage level required to achieve this balanced condition. This stored voltage level will be used to control the duty cycle of variable duty cycle oscillator 32.

As noted above, the output voltage of comparator U4 is used to control the duty cycle of variable duty cycle oscillator 32. As shown in FIG. 3, variable duty cycle oscillator 32 includes a pair of conventional 555 timers 33 and 35. In the exemplary embodiment, only the operation of timer 35 is controlled by the output of balance control comparator 30.

Timer 33 provides a fixed frequency pulse train to the trigger input 40 of timer 35. Energizing input 40 will trigger capacitor C5 to charge through R15. The charging of capacitor C5 will be monitored at threshold pin 41. When capacitor C5 charges to a predetermined percentage of the 8 volt supply voltage, the discharge pin 42 will be grounded, thereby draining the charge on capacitor C5.

By altering the voltage at control pin 44, the point at which the timer 35 goes from the charging mode to the discharge mode of capacitor C5 can be adjusted. When the timer 35 is in the charging mode, the output 43 of timer 35 is a "1". When the timer is in the discharge mode, the output 43 is "0". Thus, the output of balance control comparator 30, by altering the point at which timer 35 goes from the charging mode to the discharging mode, controls the output pulse produced by the oscillator and thereby controls the oscillator's duty cycle. In effect, the output pulse width of oscillator 32 is controlled by the comparator output. In this manner, the duty cycle of variable duty cycle oscillator 32 is controlled to compensate for the detected difference between the predetermined desired balance level and the sensed ion imbalance, as reflected by the output of low pass filter 29.

If the ion balance, as indicated by the balance control comparator 30, is too positive or too negative, the output of the variable duty oscillator 32 will be controlled to trigger transformer drive circuit 34 to ground the appropriate side of transformer primary 16 which will induce the necessary positive or negative voltage required to generate the amount of positive or negative ions needed to compensate for any ion imbalance. Transformer drive circuit 34 may, for example, include two transistor switches having outputs which are inverted versions of each other. One of the switches will respond to a "1" output of the variable duty cycle oscillator 32 to ground one side of the transformer primary. When the oscillator 32 output signal is "0", the other transistor switch will ground the other side of the transformer primary. In this manner, the pulsed output of the oscillator alternately grounds either side of transformer 16, with a fixed D.C. voltage present at the transformer primary center tap, to thereby induce a high positive or negative voltage at the transformer's output which is coupled to the ion generating electrodes 12 of the ion grid 10.

In addition, fail-safe shutdown circuitry is incorporated in the feedback loop of the ion blower 10 of the present invention. This circuitry detects whether the ion imbalance can be corrected within a predetermined period of time, or whether less than a minimum level of ions are being generated. If either of these conditions is detected, the ion blower will be disabled by the shutdown circuitry and the user will be alerted by audible and/or visual alarms.

More particularly, the shutdown and user alerting circuitry shown in FIG. 1 includes a minimum oscillation detector 50 which receives the output signal of op amp circuit 28. As noted above, op amp 28 receives its input signal from detection grid 26 which captures a predetermined percentage of the ions generated by ion grid 12, and generates an oscillating current $i_s$. If the detected current $i_s$ is oscillating below a predetermined level, this will reflect that the ion blower is operating improperly and is not generating the required amount of ions. In the exemplary embodiment, the minimum oscillation detector 50 comprises a comparator which compares the peak output voltage of op amp 28 to a predetermined voltage level. The predetermined voltage level is chosen to correspond to a peak detected current $i_s$ of approximately 200 nanoamperes. If the sensed op amp 28 output voltage level is such so as to indicate that a peak current $i_s$ of less than 200 nanoamperes was input to op amp 28, then shutdown control 52 will alert the user of this condition via LED display 58. If desired, this condition can be used to trigger disabling of the ion blower.

Balance level comparators 54 function to determine whether an ion imbalance condition exists which cannot be corrected within a reasonable period of time. The balance level comparator 54 comprise a plurality of comparators, each of which receives an input signal from low pass filter 29 which represents the net positive or negative ion imbalance. The other input to each of the balance level comparators 54 consists of a plurality of predetermined voltage levels. In the exemplary embodiment, four comparators are used and four predetermined voltage levels are compared with the ion imbalance output signal from low pass filter 29 to define imbalance ranges. For example, two comparators will define the limits of a readily balanced range. Operation in this range indicates that the system is operating properly. Two other comparators define the limits of a warning range in which the imbalance may be corrected, but if the ion imbalance increases and falls outside this range, the ion blower will be shut down. A warning LED will be energized when the system is operating in the warning range and a shutdown LED will be energized if the imbalance is such that shutdown is required.

Before the system is shut down, due to operation in an extreme imbalance condition, a predetermined time delay, e.g., five seconds, must pass. If the extreme imbalance condition is corrected during the delay, the system will not be shut down.

The final component in the shutdown subsystem is balance output signal buffer 56. This buffer stores the ion imbalance output signal from low pass filter 29. The buffer 56 is used to externally monitor the balance level in the ion blower to determine whether any calibration or balance adjustment is required.

Figure 2:
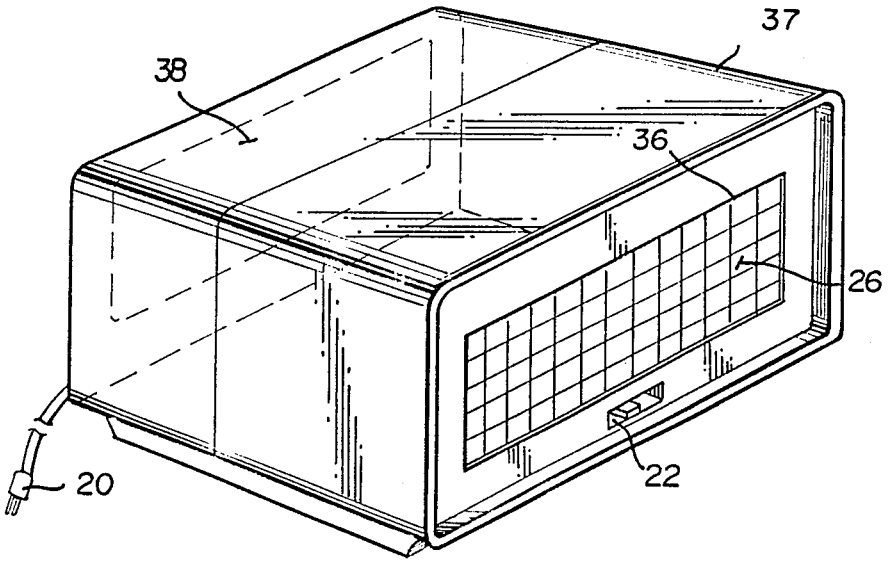
FIG. 2 is a perspective view of an ion blower as schematically represented in FIG. 1.

Turning to FIG. 2, a perspective representation of an ion blower in accordance with the preferred embodiment of the invention is illustrated. The blower includes a housing 37 provided with an ion charged air outlet 36 which is contiguous with the detecting screen 26. Detecting screen 26 need not necessarily be located within housing 37, but may be located elsewhere in the vicinity where the ion balance is desired to be controlled. An air inlet 38 is also provided for recirculating room air through the blower. It is understood that fan 24 is located interiorly of the housing 37, proximate the air inlet 38 and upstream of the electrodes 12. The on/off switch 22 protrudes from a front panel of the housing.

To briefly summarize the ion blower's operation, the ions are generated at the electrode tips and are blown outwardly by fan 24 through the ground screen to terminate the electric field lines emanating from electrodes 12. A predetermined percentage of ions are captured by the conductive detection screen 26. If a predominance of negative ions is captured, a proportionate net negative current $i_s$ is produced. The operational amplifier circuit 28 provides a voltage output proportional to the ion imbalance which is inputted to the low pass filter 29 whose output is proportionate to $i_s$, which is fed back to the ion generators via the variable duty cycle oscillator 30 and the transformer drive circuitry to thereby reduce the predominance of negative ions. If, on the other hand, the detected ion imbalance is positive, the feedback loop operates in a similar manner so that the predominance of positive ions is reduced. In addition, shutdown circuitry is incorporated such that if an ion imbalance cannot be corrected within a reasonable amount of time, or if a minimum level of ion generation is not being detected, the unit disables itself and alerts the user to these conditions through audible and visual alarms.

It is thus seen that the present invention incorporates a feedback loop in an ion generator to insure a balanced outflow of positive and negative ions within 0.05%.

While the present invention has been described in terms of its presently preferred form, it is not intended that the invention be limited only by the described embodiment. It will be apparent to those skilled in the art that many modifications may be made which nevertheless lie within the spirit and intended scope of the invention as defined in the claims which follow.

What is claimed is:

1. A dynamically balanced ion generating apparatus for adding positively and negatively charged ions to the atmosphere of a controlled environment comprising:

(a) a housing having an air inlet and air outlet;

(b) a plurality of ion generating electrodes mounted within the housing and including power supply means for applying negative and positive potential to each of said electrodes, each of said electrodes alternately generating positive and negative ions;

(c) a fan located within the housing for blowing air across the said plurality of electrodes toward said air outlet; and (d) dynamic balancing means located downstream of the electrodes for insuring that the total number of ions emanating from said air outlet contain a desired balance of positive and negative ions, said dynamic balancing means having feedback means including:

detector means for capturing at least some of said ions generated by said electrodes and for generating an alternating current signal proportional to any detected imbalance between positive and negative ions, means responsive to said alternating current signal for generating a signal indicative of a net average ion imbalance over time, and means responsive to said net ion imbalance signal for controlling said power supply means to apply negative and positive potential to said electrodes such that ions are generated to compensate for any detected imbalance.

2. A dynamically balanced ion generating apparatus as defined in claim 1, wherein said power supply means includes a high voltage transformer and means for coupling the output voltage of said transformer to said electrodes.

3. A dynamically balanced ion generating apparatus as defined in claim 2, wherein said means for coupling comprises a capacitor and wherein said transformer is a step up transformer including a center tapped primary having two side terminals, said apparatus further including transformer drive means for alternately grounding said side terminals, and means for applying a fixed DC voltage to the center tap of said transformer.

4. A dynamically balanced ion generating apparatus as defined in claim 1, wherein said detector means is constructed of electrically conductive material and is located adjacent the air outlet for capturing a predetermined percentage of the ions generated by said electrodes and for generating a net positive or negative oscillating signal current; said feedback means further including operational amplifier means for converting said signal current to an AC voltage and for holding said detector means at virtual ground.

5. A dynamically balanced ion generating apparatus as defined in claim 4, wherein said means for generating a signal indicative of an average ion imbalance over time further comprises low pass filter means, whose input is coupled to the output of said operational amplifier means, for filtering out the high frequency components of the signal generated by said operational amplifier means and for generating a signal representative of the net ion imbalance, and balance control comparator means for comparing said net ion imbalance signal with a predetermined desired ion balance level and for generating a balance control signal.

6. A dynamically balanced ion generating apparatus in accordance with claim 5, further including means for varying said predetermined desired ion balance level.

7. A dynamically balanced ion generating apparatus in accordance with claim 5, further including means responsive to said balance control signal for controlling said power supply means to generate high voltage of the appropriate polarity to result in the generation of ions which will compensate for any detected imbalance.

8. A dynamically balanced ion generating apparatus according to claim 7, wherein said power supply means includes a high voltage transformer and wherein said means for controlling said power supply means comprises variable duty cycle oscillator means for varying its duty cycle in response to said balance control signal and for producing transformer control pulses, and transformer drive means responsive to said transformer control pulses for controlling said transformer to generate the appropriate amount of positive or negative voltage to cause said ion generating electrodes to compensate for any ion imbalance.

9. A dynamically balanced ion generating apparatus according to claim 1, further including shutdown control means comprising first means for detecting whether said ion generating electrodes are generating less than a predetermined minimum amount of ions and second means for detecting whether an extreme imbalance exists between the generated number of positive and negative ions, and means responsive to each of said first and second means for detecting, for disabling said ion generating apparatus.

10. A dynamically balanced ion generating apparatus as defined in claim 9, said shutdown control means further including alarm means, responsive to each of said first and said second means for detecting for indicating that less than a predetermined minimum level of ions are being generated and for indicating that an ion imbalance condition exists.

11. A dynamically balanced ion generating means as defined in claim 5, further including buffer means connected to said low pass filter means for storing the signal representative of the net ion imbalance.

12. A dynamically balanced ion generating apparatus as defined in claim 4, said apparatus further including a ground screen disposed between said ion generating electrodes and said detection screen for terminating electric field lines emanating from said ion generating electrodes.

13. A dynamically balanced ion generating apparatus as defined in claim 1, wherein said electrodes are of the elongated pin-type and wherein said electrodes are arranged in a horizontally and vertically aligned array.

14. A dynamically balanced ion generating apparatus as defined in claim 1, wherein said detector means is located outside of said housing.

15. A dynamically balanced ion generating apparatus as defined in claim 4, wherein said operational amplifier means has a minimum current sensitivity of $500\times10^{-12}$ amperes.

16. A dynamically balanced ion generating apparatus as defined in claim 1, wherein the dynamic balancing means balances the ion concentration ratio to within 0.05%.

17. A dynamically balanced ion generating apparatus for generating positively and negatively charged ions comprising:

means for generating positively and negatively charged ions, said means for generating including a plurality of ion generating electrodes, power supply means for applying negative and positive potential to each of said electrodes, each of said electrodes alternately generating negative and positive ions, means for capturing a predetermined percentage of the generated ions and for providing an alternating current signal proportional to any detected ion imbalance between positive and negative ions, and feedback means for altering the ion output of said means for generating to insure that the number of generated positively and negatively charged ions are balanced to a desired concentration ratio, said feedback means further including:

means responsive to said alternating current signal for generating a signal indicative of the average ion imbalance over time, balance control means for comparing the average ion imbalance level with a predetermined desired imbalance level and for generating a balance control signal, and means responsive to said balance control signal for controlling said power supply means to apply positive and negative potential to each of said electrodes such that ions are generated to compensate for any detected undersided ion imbalance.

18. A dynamically balanced ion generating apparatus as defined in claim 17, wherein said power supply means includes means for generating positive and negative high voltages, and said means for controlling includes a variable duty cycle oscillator means for controlling said power supply means to generate a high voltage of the appropriate polarity to result in the generation of ions which will compensate for any detected undesired imbalance.

19. A dynamically balanced ion generating apparatus as defined in claim 18, wherein said feedback means further includes an operational amplifier means, connected to said means for capturing, for converting said alternating current signal from a current signal to an alternating current voltage signal, and wherein said means for generating a signal indicative of average ion imbalance over time includes low pass filter means for generating a DC signal representing any detected ion imbalance.

20. A dynamically balanced ion generating apparatus as defined in claim 17, wherein said means for capturing includes an electrically conductive detection screen, and said feedback means includes an operational amplifier means which holds the detection screen at virtual ground and operates as a transresistance amplifier.

21. A dynamically balanced ion generating apparatus as defined in claim 17, wherein said means for generating includes stainless alloy steel electrodes of the elongated pin-type and wherein said electrodes are arranged in a horizontally and vertically aligned array.

22. A dynamically balanced ion generating apparatus as defined in claim 17, wherein said ion generating apparatus includes a housing having an air inlet and an air outlet, and wherein said means for capturing includes a detector which is located outside of said housing.

23. A dynamically balanced ion generating apparatus as defined in claim 17, further including a ground screen, disposed between said means for generating and said means for capturing, for terminating electric field lines emanating from said means for generating.

24. An ion blower device for generating positively and negatively charged ions, said blower comprising:

(a) means for generating positively and negatively charged ions; said means for generating including a plurality of ion generating electrodes and power supply means for applying negative and positive potential to each of said electrodes, each of said electrodes generating negative and positive ions, (b) means for detecting the ion concentration ratio of positive to negative ions downstream of the ion generating means, (c) feedback means for altering the ion output of the ion generating means to insure that the number of positively and negatively charged ions generated are balanced to a desired concentration ratio, and (d) shutdown control means including first means for detecting whether said means for generating is generating less than a predetermined minimum amount of ions, second means for detecting whether an extreme imbalance exists between the generated number of positive and negative ions, and means responsive to each of said first and second means for detecting, for disabling said ion blower device.

25. In a ion generating apparatus for adding positive and negative ions to the atmosphere of a controlled environment such as an electronic assembly plant, said apparatus having a plurality of ion generating electrodes each of which generates positively and negatively charged ions, supply means for supplying positive and negative high voltage to each of said electrodes, a method for achieving a desired balance of generated positively and negatively charged ions comprising the steps of:

(a) capturing a predetermined percentage of the generated ions and generating an alternating current signal proportional to any detected imbalance between positive and negative ions, (b) generating an ion imbalance level signal indicative of the net ion imbalance average over time as reflected by said alternating current signal between the captured positive and negative ions, (c) comparing the detected ion imbalance level with a predetermined desired ion balance level, (d) controlling the power supply means of the ion generating apparatus to generate positive and negative high voltage in such a manner so as to compensate for any sensed imbalance between the detected ion imbalance level and the desired balance level, and (e) generating positive and negative ions in response to the voltage generated by the power supply means and distributing the generated ions into the atmosphere of the controlled environment.

26. A method for achieving a desired ion balance according to claim 25, further including the steps of:

(f) detecting whether less than a minimum level of ions are being generated, (g) detecting whether the ion imbalance is greater than a predetermined imbalance level, (h) providing an indication of the conditions detected in steps (f) and (g).

27. A method for achieving a desired ion balance according to claim 26, further including the step of:

(i) shutting down the ion generating apparatus in response to either of the conditions detected in step (f) or step (g).

* * * * *